US005101967A

United States Patent [19]

Sibley

[11] Patent Number: 5,101,967

[45] Date of Patent: Apr. 7, 1992

[54] DEVICE FOR STORING CONTACT LENSES

[75] Inventor: Murray J. Sibley, Westerville, Ohio

[73] Assignee: Abbott Laboratories, Abbott Park, Ill.

[21] Appl. No.: 743,964

[22] Filed: Aug. 12, 1991

[51] Int. Cl.[5] ..... B65D 85/38; A61L 2/18

[52] U.S. Cl. ..... 206/5.1; 206/210; 220/307; 422/300

[58] Field of Search ..... 206/5.1, 210, 438; 220/307; 422/300, 301, 310

[56] References Cited

U.S. PATENT DOCUMENTS

| | | | |
|---|---|---|---|
| 3,596,694 | 8/1971 | Jaeniche | 220/307 |
| 3,602,238 | 8/1971 | Brown | 206/5.1 |
| 3,822,780 | 7/1974 | Ulmer | 206/5.1 |
| 3,871,395 | 3/1975 | Murry | 134/107 |
| 4,200,187 | 4/1980 | Thomas | 206/5.1 |
| 4,228,136 | 10/1980 | Thomas | 422/307 |
| 4,396,583 | 8/1983 | LeBoeuf | 422/301 |
| 4,474,305 | 10/1984 | Marco | 220/307 |
| 4,643,329 | 2/1987 | Mobberley et al. | 220/307 |
| 4,721,124 | 1/1988 | Tuerkheimer et al. | 134/901 |
| 4,750,610 | 6/1988 | Ryder | 206/5.1 |
| 4,850,504 | 7/1989 | Grindrod et al. | 220/307 |
| 4,889,693 | 12/1989 | Su et al. | 422/113 |
| 4,996,027 | 2/1991 | Kanner | 206/5.1 |
| 5,059,402 | 10/1991 | Seamons | 206/5.1 |

FOREIGN PATENT DOCUMENTS

WO89/00430 1/1989 PCT Int'l Appl. .

*Primary Examiner*—Jimmy G. Foster

*Attorney, Agent, or Firm*—Lonnie R. Drayer; Donald O. Nickey

[57] ABSTRACT

A contact lens storage chamber has a lens retaining member disposed therein with baskets for containing the lenses disposed in a vertically juxtaposed manner. The lens retaining member has a stopper portion which is located in an opening at the top of the chamber and is retained in place by a loose tongue-in-groove structure which facilitates the escape of vapors from the chamber during a lens cleaning and disinfecting procedure.

16 Claims, 2 Drawing Sheets

DEVICE FOR STORING CONTACT LENSES

The present invention relates generally to a device for storing contact lenses, and more specifically to a contact lens storage device that may be employed in a contact lens cleaning and disinfecting system.

One of the important features of a well-designed contact lens storage device is to provide the user with an easy and convenient method for insertion into and removal of lenses from the storage without damaging the lenses. Many prior art contact lens storage devices do not have this important feature, and may in fact be susceptible to damaging lenses during insertion into and removal from the lens storage device. The contact lens storage device of the present invention provides easy access for the insertion into and removal from the device of lenses with a minimal potential for damaging the contact lenses.

Devices for retaining contact lenses wherein the lenses are disposed vertically and back-to-back are taught in U.S. Pat. Nos. 3,871,395; 4,396,583; 4,721,124; 4,750,610; and 4,889,693. Such devices have disadvantages in that a lens cleaning and disinfecting solution which functions through radicals released therefrom is unable to reach its potential efficiency because the lens surfaces which are facing one another are exposed to a lower volume of the solution in the intervening space between the lenses. Such an arrangement of the lenses, which requires holding one lens upside down while the other lens is inserted into the retaining device is not user friendly and may result in damaged lenses.

Devices for retaining lenses wherein the lenses are disposed vertically and side-by-side are taught in U.S. Pat. No. 4,228,136 and WO 89/00430. These devices accommodate only very shallow reservoirs of cleaning and disinfecting solution which are not as efficient for cleaning and disinfecting of lenses as the deeper reservoir of the device disclosed herein, and the upper surfaces of the lenses may not be cleaned and disinfected as well as in the device of the present invention as radicals from the solution rise in the solution.

To acquaint persons skilled in the art with the principles of the invention, a presently preferred embodiment illustrative of the best mode now contemplated for the practice of the invention is described herein making reference to the attached drawings forming a part of the specification and in which drawings.

Figure 1:
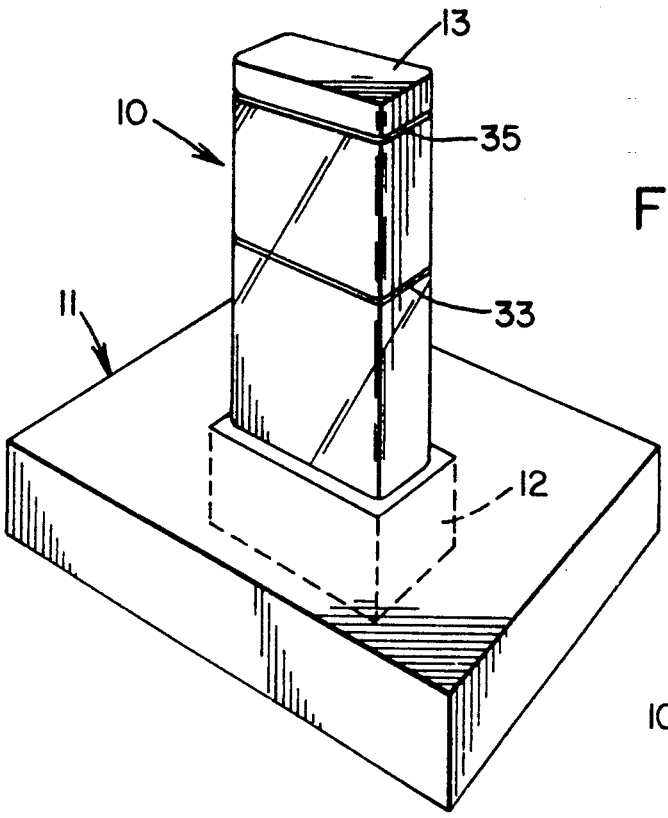
FIG. 1 is a perspective view of a contact lens storage device in accordance with the present invention.

With reference to FIG. 1 a contact lens storage device in accordance with the present invention has a contact lens storage chamber 10 may be used in conjunction with an electrical device 11 for cleaning and disinfecting contact lenses. The base 12 of the contact lens storage chamber according to a preferred embodiment is removably insertable in a well in the electrical device such that the contact lens storage chamber is disposed vertically when in its operative position. A lens retaining member is disposed partially within the lens storage chamber with a cap 13 which is a part of the lens retaining member disposed external of the chamber at an open end of the lens storage chamber.

Figure 3:
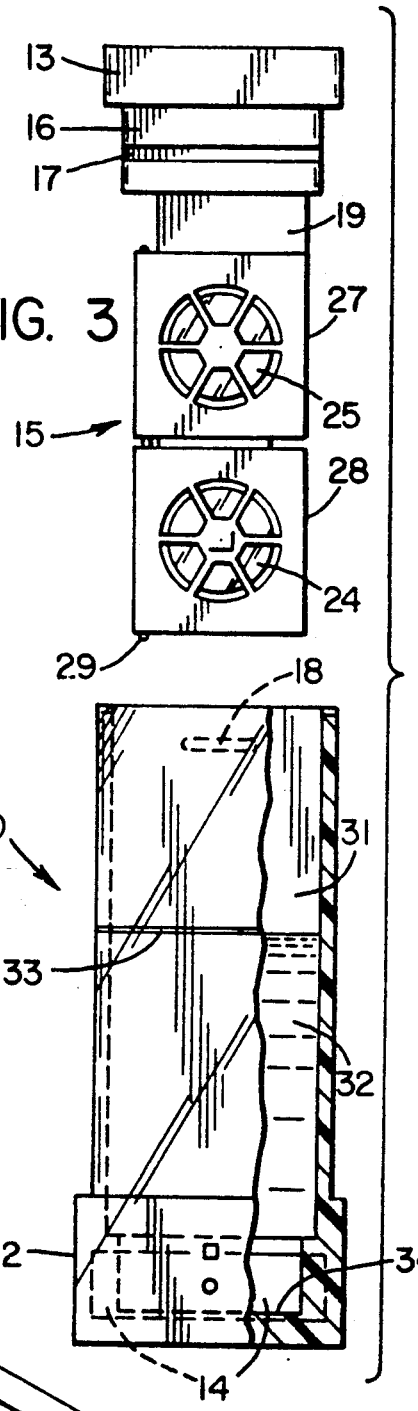
FIG. 3 is an exploded side view, partially broken away, of a contact lens storage chamber and lens retaining member of a contact lens storage device in accordance with the present invention.
Figure 2:
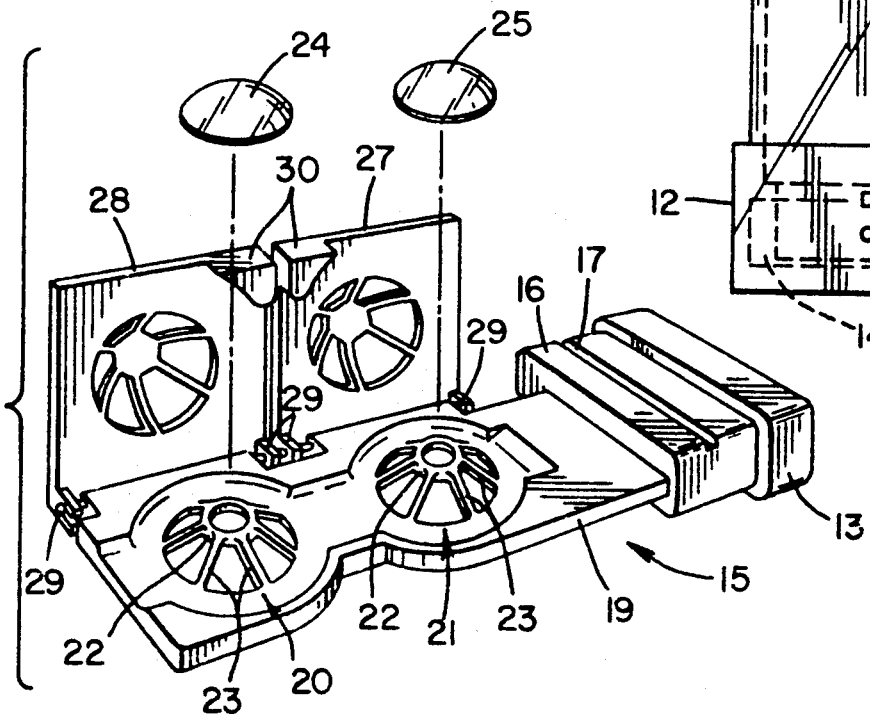
FIG. 2 is a perspective view of the lens retaining member of a contact lens storage device in accordance with the present invention.
Figure 4:
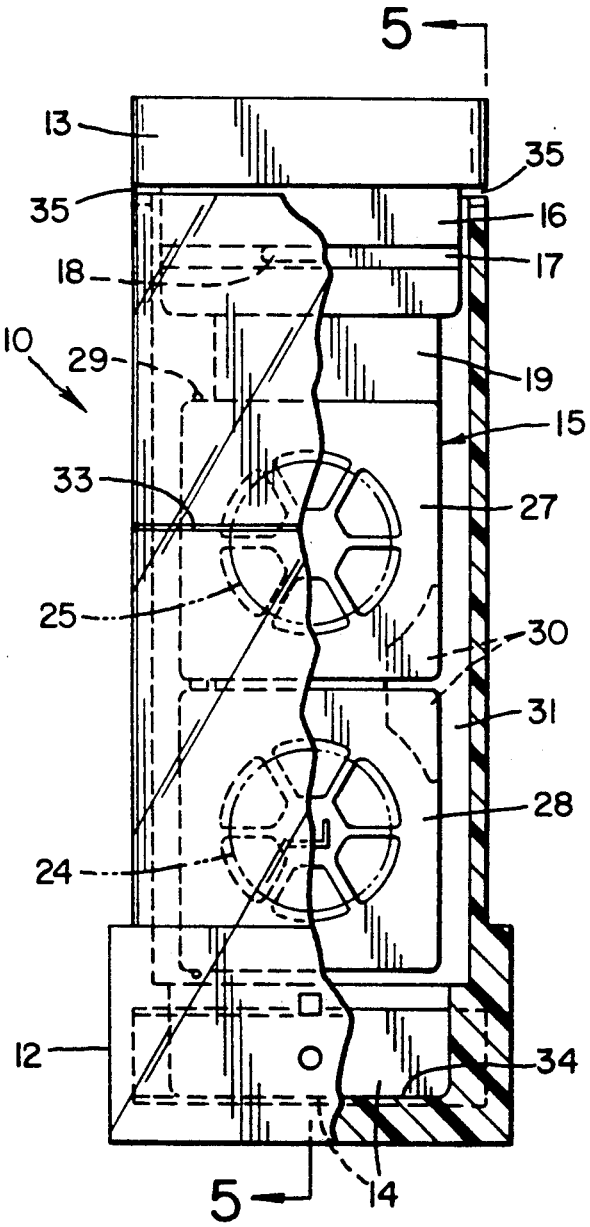
FIG. 4 is a side elevation view, partially broken away, of an assembly of a contact lens storage chamber and lens retaining member in an operative relationship.
Figure 5:
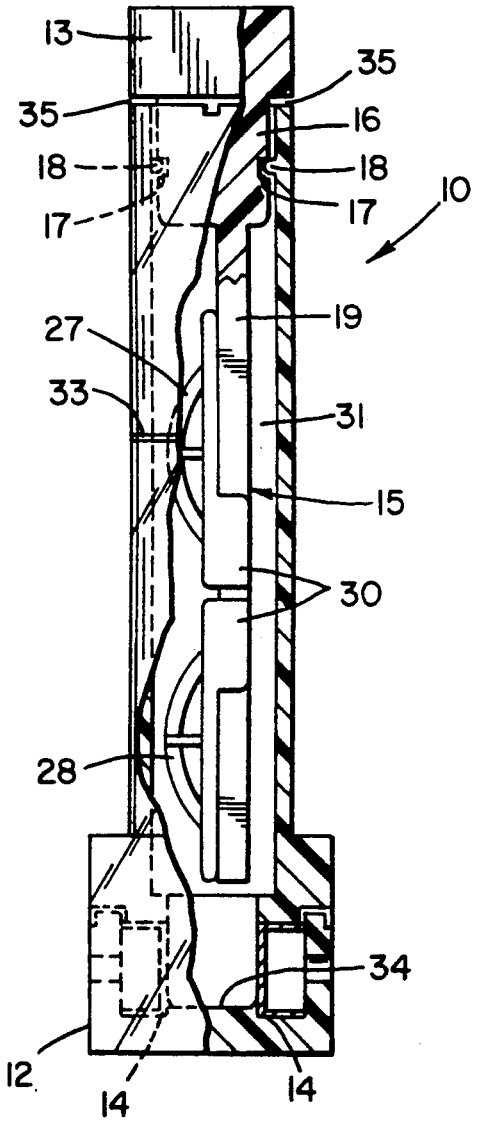
FIG. 5 is a front elevation view, partially broken away, of the assembly which is illustrated in FIG. 4 looking in the direction of arrows 5—5 in FIG. 4.

The structure of the lens retaining member 15 and lens storage chamber 10 may be best understood by referring to FIGS. 3–5. In a preferred embodiment the base 12 of the lens storage chamber has a pair of electrodes 14 embedded therein which function to send a mild electric current through a lens cleaning and disinfecting solution. Preferably, the electrodes are made of a metal alloy or other conducting material which is not readily oxidized. The electrical device 11 provides a small current to the electrodes 14. A method and apparatus for an electrochemical contact lens disinfection and neutralization system is taught in WO 89/00430. It is understood that the contact lens storage device of the present invention may alternatively be employed in a contact lens cleaning and disinfecting system using hydrogen peroxide as a lens cleaning and disinfecting solution, or other appropriate chemical solutions, and the electrodes 14 eliminated from the structure. In such an alternative embodiment the electrical device 11 may be replaced by a simple support structure which will maintain the lens storage chamber in an upright orientation.

In a preferred embodiment the lens storage chamber is formed of a transparent or translucent plastic material which is not reactive with the lens cleaning and disinfecting solution. In a preferred embodiment the lens storage chamber has a horizontal cross-section which is rectangular, but it is understood that the horizontal cross-sectional shape of the lens storage chamber may be circular, oval or any other suitable shape without departing from the scope of the invention.

A fill line 33 on a side of the lens storage chamber indicates the level to which the cavity 31 should be filled with a suitable lens cleaning and disinfecting solution 32.

Ridges 18 are disposed on opposing interior surfaces of the walls of the lens storage chamber. The ridges on the interior surfaces of the lens storage chamber interlock with grooves 17 in the lens retaining member in a manner that will more fully described in the following description of the lens retaining member 15.

The lens retaining member 15 comprises a cap portion 13, a stopper portion 15 which is attached to a bottom side of the cap portion and a plate portion 19 which is attached to a bottom side of the stopper portion. The plate portion has a pair of hinged baskets 20, 21 integral therewith, which are vertically juxtaposed when the assembly of the lens storage chamber and lens retaining member is in its operative position. Put another way, when the plate portion 19 of the lens retaining member is oriented vertically, the hinged baskets 20, 21 are disposed one above the other. Each of the hinged baskets has a lid 27, 28 which is attached by hinge members 29 to the plate portion 19. The hinged baskets have spokes 23 extending from a hub 22, with similar structures on both the plate portion 19 and the lids 27, 28 so that each basket has a very open structure allowing contact lenses 24, 25 to be totally surrounded by the lens cleaning solution. The lids 27, 28 have locking members 30 for retaining the lids in a closed relationship with respect to the plate portion 19.

As best seen in FIG. 5 the ridges 18 on the interior of the lens storage chamber, near the opening at the top of the chamber, mate loosely with the grooves 17 in the stopper portion 16 of the lens retaining member. Both the grooves 17 and ridges 18 extend horizontally. The grooves are wider, deeper and longer than the ridges. Gasses which are generated from the lens cleaning and disinfecting solution during the lens cleaning procedure are allowed to escape from the chamber 31 by way of the gaps 35, 36 between the cap portion 13 and the walls of the chamber.

The vertically juxtaposed orientation of the lens containing baskets 27, 28 allows the radicals released by the lens cleaning and disinfecting solution, for example due to electrolysis, to clean and disinfect both lenses as the radicals progress upwardly from the bottom 34 of the chamber towards the gaps 35, 36 at the top of the lens storage chamber. As a result of the arrangement of the components in a contact lens storage device of the present invention a substantially smaller quantity of lens cleaning and disinfecting solution is necessary for the cleaning and disinfecting process.

While certain representative embodiments and details have been shown for the purpose of illustrating the invention, it will be apparent to those skilled in the art that various changes and modifications may be made therein without departing from the spirit or scope of the invention.

I claim:

1. An apparatus for storing contact lenses comprising a contact lens storage chamber and a lens retaining member, the storage chamber having an opening at the top thereof and a pair of substantially, horizontally disposed ridges on the interior of the storage chamber, the lens retaining member having a cap portion, a stopper portion which is attached to a bottom side of the cap portion, and a plate portion which is attached to a bottom side of the stopper portion and extends vertically, the stopper portion being disposed in the opening at the top of the storage chamber and having a pair of substantially horizontally disposed grooves therein, said grooves being deeper, longer and wider than said ridges, and said ridges being disposed in said grooves, the plate portion of the lens retaining means having a pair of baskets which are vertically juxtaposed integral therewith for containing contact lenses.

2. An apparatus for storing contact lenses according to claim 1 wherein a horizontal cross section of the contact lens storage chamber is rectangular.

3. An apparatus for storing contact lenses according to claim 2 wherein said baskets have hinged lids.

4. An apparatus for storing contact lenses according to claim 3 further comprising a base member which supports the lens storage chamber in a substantially vertical orientation.

5. An apparatus for storing contact lenses according to claim 2 further comprising a base member which supports the lens storage chamber in a substantially vertical orientation.

6. An apparatus for storing contact lenses according to claim 1 wherein the stopper portion of the lens retaining means is spaced apart from the interior of the lens storage chamber such that vapors may escape from the lens storage chamber during a lens cleaning and disinfecting procedure.

7. An apparatus for storing contact lenses according to claim 6 wherein the stopper portion of the lens retaining means is spaced apart from the interior of the lens storage chamber such that vapors may escape from the lens storage chamber during a lens cleaning and disinfecting procedure.

8. An apparatus for storing contact lenses according to claim 7 wherein said baskets have hinged lids.

9. An apparatus for storing contact lenses according to claim 8 further comprising a base member which supports the lens storage chamber in a substantially vertical orientation.

10. An apparatus for storing contact lenses according to claim 7 further comprising a base member which supports the lens storage chamber in a substantially vertical orientation.

11. An apparatus for storing contact lenses according to claim 6 wherein said baskets have hinged lids.

12. An apparatus for storing contact lenses according to claim 11 further comprising a base member which supports the lens storage chamber in a substantially vertical orientation.

13. An apparatus for storing contact lenses according to claim 6 further comprising a base member which supports the lens storage chamber in a substantially vertical orientation.

14. An apparatus for storing contact lenses according to claim 1 wherein said baskets have hinged lids.

15. An apparatus for storing contact lenses according to claim 14 further comprising a base member which supports the lens storage chamber in a substantially vertical orientation.

16. An apparatus for storing contact lenses according to claim 1 further comprising a base member which supports the lens storage chamber in a substantially vertical orientation.

* * * * *